United States Patent [19]

Ganter et al.

[11] Patent Number: 4,697,361

[45] Date of Patent: Oct. 6, 1987

[54] BASE FOR AN ARTICLE OF FOOTWEAR

[76] Inventors: Paul Ganter, Tannenweg 21; Max Ganter, Rosenweg 7, both of D-7808 Waldkirch, Fed. Rep. of Germany

[21] Appl. No.: 825,459

[22] Filed: Feb. 3, 1986

[30] Foreign Application Priority Data

Aug. 3, 1985 [DE] Fed. Rep. of Germany ..... 3527938

[51] Int. Cl.[4] ..... A43B 13/00; A43B 13/04; A43B 13/20

[52] U.S. Cl. ..... 36/28; 36/59 R; 36/59 C; D2/320

[58] Field of Search ..... 36/28, 114, 59 R, 59 C, 36/29, 32 R, 28 R, 103, 116, 8.1; D2/320

[56] References Cited

U.S. PATENT DOCUMENTS

| | | | |
|---|---|---|---|
| D. 267,288 | 12/1982 | Davis | D2/320 |
| 2,424,463 | 7/1947 | Hogg | 36/59 C |
| 3,086,532 | 4/1963 | Mistarz | 36/32 R |
| 3,100,354 | 8/1963 | Lombard et al. | 36/25 R |
| 4,259,792 | 4/1981 | Halberstadt | 36/28 |
| 4,266,349 | 5/1981 | Schmohl | 36/32 R |
| 4,439,936 | 4/1984 | Clarke et al. | 36/32 R |
| 4,494,320 | 1/1985 | Davis | 36/32 R |
| 4,494,321 | 1/1985 | Lawlor | 36/28 |

FOREIGN PATENT DOCUMENTS

| | | | |
|---|---|---|---|
| 1708672 | 6/1955 | Fed. Rep. of Germany . | |
| 1485580 | 2/1969 | Fed. Rep. of Germany . | |
| 2752300 | 5/1979 | Fed. Rep. of Germany . | |
| 3109199 | 3/1981 | Fed. Rep. of Germany . | |
| 3037108 | 5/1982 | Fed. Rep. of Germany . | |
| 3308731 | 9/1984 | Fed. Rep. of Germany . | |
| 584489 | 2/1925 | France | 36/8.1 |
| 2500278 | 8/1982 | France . | |
| 149599 | 8/1920 | United Kingdom | 36/59 C |

*Primary Examiner*—Henry S. Jaudon
*Assistant Examiner*—Steven N. Meyers
*Attorney, Agent, or Firm*—Peter K. Kontler

[57] ABSTRACT

The elastically deformable base of an article of footwear has a substantially plane lower surface which is formed with a deep recess below the heel, with an elongated shallow recess below the outer portion of the instep, with a two-part recess below the ball and with a two-part recess below the toes of the foot resting on the upper surface of the base. The depth of the recesses is reduced to zero or close to zero when the corresponding sections of the base are stressed by the adjacent portions of the foot during walking, jogging or running. The depth of the recesses is proportional to the magnitude of shocks or stresses which are transmitted to the corresponding sections of the base in actual use of the article of footwear. The upper surface of the base is deformed in response to a reduction of the depth of recesses in the plane lower surface so that the profile of the foot is imprinted into successive portions of the upper surface when the article of footwear is in use.

32 Claims, 10 Drawing Figures

BASE FOR AN ARTICLE OF FOOTWEAR

BACKGROUND OF THE INVENTION

The present invention relates to articles of footwear in general, especially to articles of outer footwear, and more particularly to improvements in the bases of such articles of footwear (hereinafter called shoes for short). Still more particularly, the invention relates to improvements in footwear bases which are made of elastically deformable and compressible material so that the bases can yield in response to the application of stresses and shocks by the feet of the wearers of the shoes.

German Offenlegungsschrift No. 1 485 580 discloses a shoe whose base has a recess below the heel of the foot. This is supposed to enhance the stability of the base on the floor or on the ground and to furnish a desirable damping action. The recess is surrounded by a rather wide ridge whose purpose is to protect the heel during jumping and the resulting pronounced impacts of the heel portion of the base against the ground or floor.

U.S. Pat. No. 4,259,792 discloses an article of outer footwear wherein the heel portion of the base is also formed with a recess to enhance the shock absorbing characteristics of the base.

German Offenlegungsschrift No. 27 52 300 discloses a shoe wherein the underside of the heel has an uneven and slanting rear portion in order to enhance the rolling action of the heel in response to initial contact with the floor or ground.

Attempts to enhance the comfort of the foot during jumping, walking, jogging or running include the provision of footwear bases with profiled upper surfaces. Such proposal is not entirely satisfactory because the configuration of the prefabricated upper surface of the base may or may not conform to the shape of the foot of the purchaser of the shoe. In fact, such bases are likely to cause pronounced discomfort to the wearer of the shoe and can lead to twisting of the ankle and/or other injuries. Furthermore, such bases are likely to inadequately support the foot so that the wearer is tired after a relatively short period of exercising or walking and the feet of the user are likely to be deformed as a result of the use of such shoes.

OBJECTS AND SUMMARY OF THE INVENTION

An object of the invention is to provide a novel and improved footwear base which is more comfortable to the wearer than the aforediscussed conventional bases and whose upper surface need not be molded and/or otherwise shaped by the manufacturer of the article of footwear.

Another object of the invention is to provide a relatively simple and inexpensive base which adequately supports and braces the foot during each stage of walking, running, jogging or jumping.

A further object of the invention is to provide a base whose lower surface is configurated in a novel and improved way.

An additional object of the invention is to provide a base which does not cause discomfort to the wearer, even after long periods of use, and which automatically conforms to the shape of the foot during different stages of walking, jogging, running or jumping.

Still another object of the invention is to provide a novel and improved article of footwear which embodies the above outlined base.

Another object of the invention is to provide a base whose upper surface can be flat or substantially flat when the article of footwear is not in use.

A further object of the invention is to provide a base which can be used in articles of footwear for professional or amateur athletes, children, adolescents, adults, senior citizens, persons of both sexes, for recreational purposes, in competition and/or on the job.

Another object of the invention is to provide a base whose stability is superior to that of conventional bases.

A further object of the invention is to provide a base which can be mass-produced from a wide variety of available materials.

The invention is embodied in a footwear base (combined sole and heel) which contains or consists of an elastically deformable cushioning (shock-absorbing) material and has an upper surface for supporting the weight of the foot and a substantially plane lower surface which serves to contact the floor or ground. The base includes a first part which absorbs more pronounced shocks or stresses and a second part which absorbs less pronounced shocks or stresses when the article of footwear embodying such base is in actual use. The lower surface has recessed portions on the first part of the base. The first part includes a first section below the ball, a second section below the toes, a third section below the heel and a fourth section below the outer part of the instep of the foot which is adjacent to the upper surface. Each recessed portion of the lower surface has at least one recess.

The second part preferably includes a bridge between the recessed portions on the third and fourth sections of the first part. The recesses of the recessed portions on the first and fourth sections of the first part may but need not communicate with each other, i.e., the second part may but need not include a bridge between the recessed portions on the first and fourth sections of the first part. The second part can further include a bridge between the recessed portions on the first and second sections of the first part, and the recessed portion on the second section (below the toes of the foot which is adjacent to the upper surface) can have several discrete recesses. Such discrete recesses preferably include a first recess below the big toe and a second recess below the other toe or toes of the foot which is adjacent to the upper surface of the base.

The recesses of at least some of the recessed portions can have different depths. The depths of such recesses can be proportional to the magnitude of shocks or forces which are applied to the corresponding portions of the upper surface when the article of footwear (e.g., a running or jogging shoe) is in use. The recess of the recessed portion on the third section of the first part is preferably deeper than at least one other recess. Furthermore, the recess in the recessed portion on the first section is preferably deeper than at least one other recess. That portion of the lower surface which is provided on the first section can have several recesses at least one of which is preferably deeper than at least one other recess. Analogously, at least one recess in that portion of the lower surface which is provided on the second section is preferably deeper than at least one other recess, and such deeper recess is preferably located below the big toe of the foot which is adjacent to the upper surface.

The depth of recesses in unstressed condition of the respective sections (and the elasticity or deformability of the material of the base) is preferably such that the depth of at least a predetermined portion of each recess is reduced (or is close) to zero in response to the application of a shock or stress to the respective section of the first part when the article of footwear embodying the base is in use. The predetermined portions preferably constitute or include the central portions of the respective recesses.

The lower surface preferably further includes serrated or non-serrated non-recessed portions. The recessed portions may but need not be serrated.

Still further, the lower surface preferably includes additional or intermediate portions which merge substantially gradually and/or abruptly into the recessed and non-recessed portions. If the recesses include deeper and shallower recesses, the additional portions of the lower surface can define steps of identical or similar height, and the number of steps adjacent to the deeper recesses preferably exceeds the number of steps which are adjacent to the shallower recesses. As mentioned above, the deeper recesses can include a recess in that portion of the lower surface which is provided on the third section of the first part, and preferably also recesses in those portions of the lower surface which are provided on the first and second sections. The arrangement may be such that the additional portions of the lower surface have pairs of steps surrounding the deeper recesses and single steps surrounding the shallower recesses. The height of each step can be between about 0.5 and 1.5 mm, preferably between about 0.75 and 1 mm, and most preferably between about 0.8 and 1 mm. The steps can merge gradually into the non-recessed portions and can establish abrupt transitions between the additional portions and the recessed portions of the lower surface. The maximum depth of the recesses need not appreciably exceed 3 mm. The recesses are preferably spaced apart from the marginal or peripheral part of the base.

As mentioned above, the second part can include a (non-recessed) bridge between the recessed portions on the first and fourth sections of the first part. In accordance with one presently preferred embodiment, the recess in that portion of the lower surface which is provided on the first section of the first part extends transversely of the base toward but short of the recess in the recessed portion on the fourth section of the first part. In many instances, the recess or recesses of the recessed portion on the fourth section of the first part are shallower than the other recesses (or shallower than at least some of the other recesses). As mentioned above, such other recesses can have different depths (for example, the recess of the recessed portion on the third section can be deeper than the recess or recesses of the recessed surface portion or portions on the first and/or second section of the first part).

The novel features which are considered as characteristic of the invention are set forth in particular in the appended claims. The improved footwear base itself, however, both as to its construction and the mode of making the same, together with additional features and advantages thereof, will be best understood upon perusal of the following detailed description of certain specific embodiments with reference to the accompanying drawing.

DESCRIPTION OF THE PREFERRED EMBODIMENTS

Referring first to FIGS. 1 to 7, there is shown a footwear base 1 which constitutes a combined one-piece sole and heel of an article of footwear (e.g., a shoe or a sandal) and has a substantially plane or flat lower surface or underside 2 and a slightly concave upper surface or upper side 102. The base 1 is made of an elastically deformable cushioning material and can be assembled of two or more layers made primarily or exclusively of a suitable synthetic plastic substance.

Figure 3:
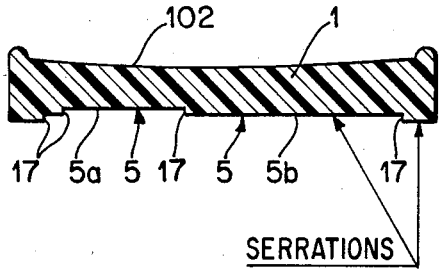
FIG. 3 is a sectional view as seen in the direction of arrows from the line III—III of FIG. 1.
Figure 4:
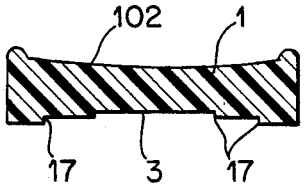
FIG. 4 is a sectional view as seen in the direction of arrows from the line IV—IV of FIG. 1.
Figure 5:
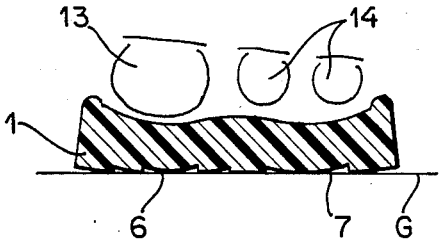
FIG. 5 is a sectional view similar to that of FIG. 2 but showing the corresponding section of the first part of the base in deformed condition.
Figure 6:
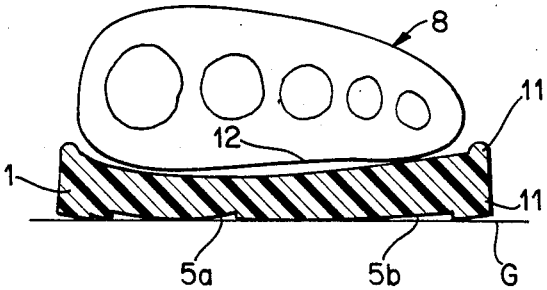
FIG. 6 is a view similar to that of FIG. 3 but showing the corresponding section of the first part in deformed condition.

The base 1 includes a first part which absorbs more pronounced shocks or stresses when the article of footwear is in use, a second part which absorbs less pronounced shocks or stresses, and a third or marginal (peripheral) part 11. The first part includes a first section which supports the ball 12 of the foot 8 resting on the upper surface 102 (such first section is shown in FIGS. 3 and 6), a second section (shown in FIGS. 2 and 5) which supports the toes 13, 14 of the foot 8 resting on the upper surface 102, a third section (shown in FIGS. 4 and 7) which supports the heel 9 of the foot 8 resting on the upper surface 102, and a fourth section which includes the instep 18 and is disposed between the sections of FIGS. 3 and 4.

Figure 1:
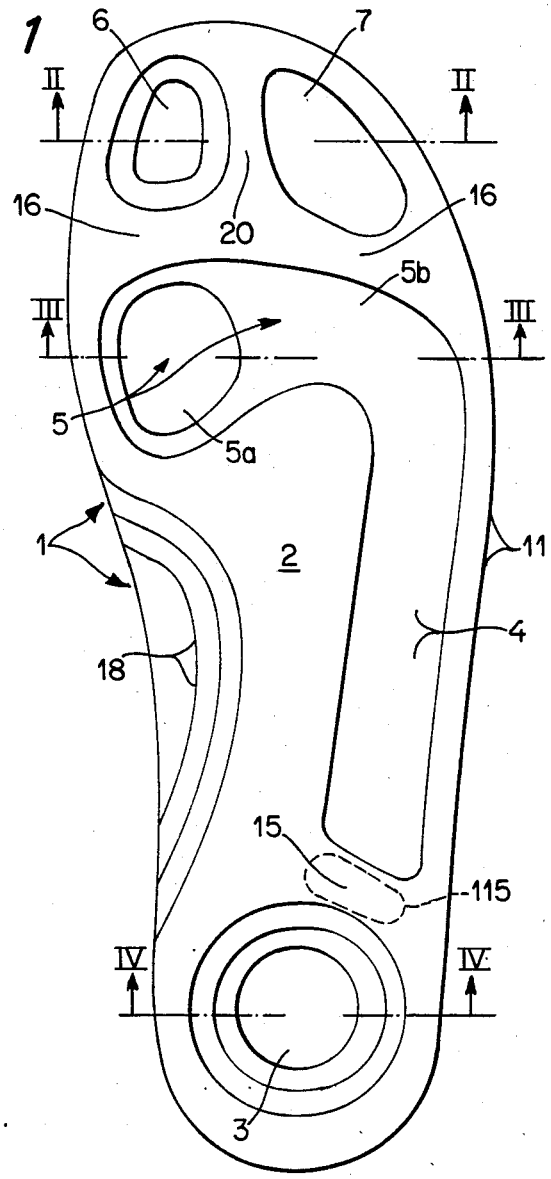
FIG. 1 is a bottom plan view of a base which embodies one form of the invention wherein the recess in the fourth section of the first part of the base merges into the recess in the first section of the first part.
Figure 2:
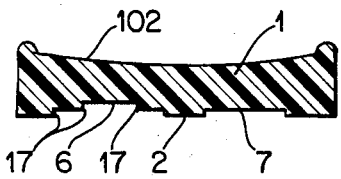
FIG. 2 is a sectional view as seen in the direction of arrows from the line II—II of FIG. 1.

The lower surface 2 of the base 1 includes a recessed portion which is provided on the first section of the first part of the base 1 and has a composite recess 5 including a deeper recess **5*a* and a shallower recess 5*b* in communication with the recess 5*a*. The recesses 5*a*, 5*b* extend transversely of the base 1 and are spaced apart from the third or marginal part 11 of the base. The lower surface 2 further includes a second recessed portion which is provided on the second section of the first part of the base 1 and has two discrete recesses including a deeper recess 6 below the big toe 13 of the foot 8 resting on the upper surface 102 and a shallower recess 7 below the remaining toes 14 or below one or more small toes 14. A third recessed portion of the lower surface 2 is provided on the third section of the first part of the base 1 and has a relatively deep recess 3 below the heel 9 of the foot 8 on the upper surface 102. A fourth recessed portion of the lower surface 2 is located below the outer part of the instep (below the outer metatarsus or metatarsi and below the cuboid bone of the foot 8 on the upper surface 102), and such fourth portion of the lower surface 2 has a relatively shallow elongated recess 4 which communicates with the shallower recess 5*b* in the first recessed portion of the lower surface 2. As can be seen in FIG. 1, all of the recesses 3, 4, 5*a*, 5*b*, 6 and 7 are spaced apart from the third or marginal part 11 of the base 1. The latter further comprises the aforementioned second part which takes up less pronounced stresses when the article of footwear embodying the base 1 is in actual use, and such second part includes two bridges 15, 16 as well as those portions of the base which are immediately adjacent to the marginal part 11. The bridge 15 is disposed between the recesses 3, 4 and the bridge 16 is disposed between the recesses 5*a*, 5*b* on the one hand and the recesses 6, 7 on the other hand. That (non-recessed) portion of the lower surface 2 which is provided on the second part of the base 1 is or can be serrated (the serrations can include longitudinally and/or transversely extending straight or undulate ribs and grooves in the non-recessed portion of the surface 2), and this is indicated in FIG. 3 by a legend reading "SERRATIONS". Additional serrations can be provided on the recessed portions of the lower surface 2, i.e., in the recess 3, 4, 5*a*, 5*b*, 6 and/or 7. This, too, is indicated in FIG. 3** by the aforementioned legend.

The lower surface 2 of the base 1 further includes additional or intermediate portions which are disposed between the recessed and non-recessed portions and include circumferentially complete steps 17 as well as steps 17 of finite length. Thus, the base 1 includes a first part with four sections having the aforementioned recesses 3–7, a second part including the aforementioned bridges 15, 16, and the marginal part 11, and the lower surface 2 includes first portions with recesses 3–7, a second portion on the bridges 15, 16 and along the marginal part 11, and an additional or intermediate portion between the first and second portions.

Figure 7:
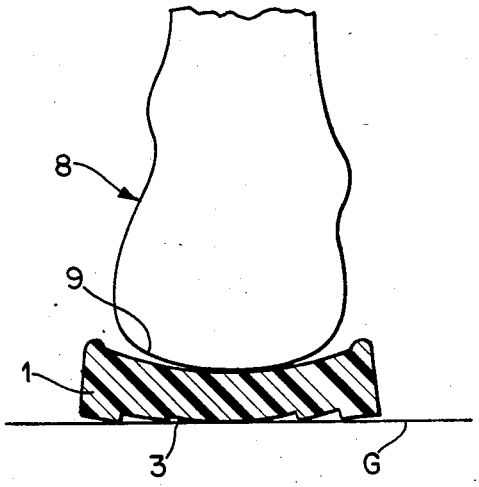
FIG. 7 is a sectional view similar to that of FIG. 4 but showing the corresponding section of the first part in deformed condition.

An imaginary line or track connecting the recesses 3, 4, **5*b*, 5*a*, 6 and 7 denotes those portions of the base 1 which are subjected to more pronounced stresses or shocks when the base 1 rolls along the floor or ground G while the user of the article of footwear including the base 1 is jogging, jumping, running or walking, and the depth of the recesses 3–7 can be selected in such a way that it is proportional to the magnitude of shocks or stresses which are applied to the respective sections of the first part of the base 1. The recess 4 extends substantially longitudinally of the base 1 and the composite recess 5 including the recesses 5*a*, 5*b* extends transversely of the base at the front end of the recess 4 and behind the recesses 6, 7 in the second portion of the lower surface 2. When the user of the article of footwear is in motion, the recess 3 is lifted above the round ahead of the recess 4, the latter is lifted above the ground ahead of the recesses 5*a*, 5*b*, and the recesses 5*a*, 5*b* are lifted off the ground ahead of the recesses 6, 7. The material of the base 1 yields when it takes up pronounced stresses or shocks whereby the depth of predetermined portions (preferably including the central portions) of the recesses 3 to 7 is reduced to or close to zero in a manner as shown in FIGS. 5 to 7. Thus, the area of contact between the recessed portions of the lower surface 2 and the floor or ground G increases and decreases during rolling of the lower surface along the floor or ground. This reduces the likelihood of twisting of the ankle and/or other injuries to the wearer of the article of footwear. In other words, successive sections of the first part of the base 1 are firmly planted on the ground or floor G during successive stages of rolling of the base along the ground or floor while the wearer is in the process of lifting successive portions of the first part off the ground or floor in order to perform a step and to return the base 1** into contact with the ground or floor at another location.

If desired, the underside of the bridge 15 (i.e., the corresponding second portion of the lower surface 2) can be provided with one or more relatively shallow recesses 115 (one such recess is indicated in FIG. 1 by broken lines). The bridge 15 stabilizes the foot 8 during walking, jogging or running and is particularly effective in preventing a twisting of the ankle.

The recess 4 merges into the adjacent recess **5*b* (which, in turn, merges into the recess 5*a*) so that the corresponding sections of the first part of the base 1 can conform to the shape of the foot 8 and can come into actual contact with the floor or ground G during the respective stage of rolling of the base along the floor or ground, i.e., while the stressing of the base is shifted in a direction from the heel 9, along the outer portion of the instep 18, along the ball 12 and toward the toes 13 and 14. The weight of the foot 8 is shifted from the outer half of the marginal part 11 toward the inner half of the marginal part while the first part of the base 1 undergoes deformation in a direction from the front portion of the recess 4 toward the deeper left-hand recess 5*a* below the ball 12 of the foot 8 on the upper surface 102**.

The purpose of the bridge 16 between the recesses **5*a*, 5*b* and 6, 7 is to prevent excessive yielding or compression of the corresponding portion of the second part of the base 1 while the stressing is in the process of being shifted from the ball 12 toward the toes 13 and 14. Thus, the upper surface 102 of the base 1 develops a bead or ridge in the region of the bridge 16 so that the undersides of the toes 13 and 14 can bear against the front side of such bead while the foot 8 is in the process of lifting the foremost portion of the base 1** off the ground. Such bead can be compared with starting blocks which are used by sprinters to ensure a more satisfactory start of a relatively short race.

The recess 7 can but need not merge into the recess 6. In either event, the recess 6 is preferably deeper than the recess 7 so as to ensure that the big toe 13 can deform the corresponding section of the base 1 to a greater extent than the small toes 14. This is desirable and advantageous because the big toe 13 normally transmits more pronounced stresses than the other toes 14. The bridge 20 between the recesses 6 and 7 ensures that the corresponding portion of the second section of the base 1 yields very little or not at all when the article of footwear is in actual use. This contributes to more reliable guidance of the foot 8 and reduces the likelihood of twisting and/or other injuries or discomfort. Thus, the base 1 yields in the regions of the recesses 6, 7 but not in the region of the bridge 20 or, at the very least, the region above the bridge 20 yields less than the adjacent regions of the second section of the base.

FIG. 1 shows that the recesses 3–7 together form a pattern which is a mirror image of the pattern formed in the smooth upper surface of a layer of sand in response to depression of the foot 8 thereinto. As mentioned above, the depth of predetermined portions of (or of the entire) recesses 3–7 can be reduced to zero when the corresponding parts of the foot 8 exert pressure on the respective portions of the upper surface 102 of the base 1. Thus, the recesses 3–7 enable the upper surface 102 to conform to the shape of the underside of the foot 8 while the foot is gradually lifted starting at the heel 9 and proceeding toward the toes 13 and 14. As stated above, the depth of the recess 3 preferably exceeds the depth of one or more other recesses 4, 5*a*, 5*b*, 6, 7, and the same preferably applies for the recesses 5*a* and 6. Thus, the recesses 5*a*, 6 can be as deep as, or somewhat shallower than, the recess 3 but are deeper than the recesses 4, 5*b*, and 7. This can be readily seen in FIGS. 2, 3 and 4. The inner portion of the instep 18 is provided with a relatively deep depression which extends all the way to the corresponding portion of the marginal part 11 of the base 1. Deeper recesses enable the corresponding sections of the base 1 to yield to a greater extent than the sections above the shallower recesses so that the lower surface portions below the deeper recesses can come into contact with the floor or ground G (see FIGS. 5, 6 and 7) during application of pronounced shocks or stresses to the respective regions of the base 1. More specifically, FIGS. 5, 6 and 7 show that the depth of the normally deeper recesses 6, 5*a*, 3 can be reduced to that of the shallower recesses 4, 5*b* and 7 (or all the way to zero) when the corresponding sections of the base 1 are stressed by the toes 13, 14 by the ball 12 and by the heel 9, respectively. Thus, the recesses 3–7 temporarily disappear while the base 1 is caused to roll along the floor or ground G in a direction from the third toward the first section. Such deformation of the base 1 is desirable and advantageous because the stressed or compressed section of the base is invariably moved into a larger-area contact with the floor or ground G. This reduces the likelihood of twisting of the ankle and/or other injuries and enables the upper surface 102 to readily conform to the shape of the adjacent portions of the foot 8. The provision of aforediscussed serrations on the bridges 15, 16, 20 and in the recesses 3–7 also contributes to more reliable contact between the base 1 and the floor or ground G during each stage of rolling of the base along the ground. The serrations can contribute significantly to a reduction of the likelihood of slippage of the base along the floor or ground.

The aforediscussed additional portions of the lower surface 2 are provided with endless steps 17 and with steps 17 of finite length, and such steps can establish gradual and/or abrupt transitions between the recessed and non-recessed portions of the lower surface 2. The arrangement can be such that the steps 17 enable the additional portions of the lower surface 2 to merge gradually into the non-recessed portions (on the bridges 15, 16 and 20) and that the steps provide abrupt transitions into the recessed surface portions. This can be seen in FIGS. 2 to 5. Each shallower recess (such as 4, 5*b* and 7) can be surrounded by a single step 17, and each deeper recess (such as 3, 5*a* and 6) can be surrounded by two steps 17. The steps 17 constitute one of the presently preferred means for establishing transitions between the recessed and non-recessed portions of the lower surface 2. It is equally within the purview of the invention to provide the base 1 with a lower surface 2 whose additional or intermediate portions establish only smooth, gradual, (i.e., unstepped) transitions between the recessed and non-recessed portions.

The height of each step 17 (as considered in the direction from the lower surface 2 toward the upper surface 102) can be the same, and such height preferably does not exceed 3 mm. It is presently preferred to provide the surface 2 with steps 17 whose height is between 0.5 and 1.5 mm, more preferably between 0.75 and 1 mm, and most preferably between 0.8 and 1 mm.

The feature that the second part of the base 1 includes a substantially uninterrupted portion extending along the major portion of the marginal part 11 all the way to the front and rear portions of the inner part of the instep 18 contributes significantly to stability of the base 1 because the latter is less likely to allow for a twisting of the foot 8 in actual use of the article of footwear. Such stability is enhanced due to the fact that the material of the base 1 can yield so that the depth of the recesses 3–7 is reduced in response to the application of stresses to the corresponding portions of the upper surface 102 whereby successive portions of the foot 8 rest on substantially plane portions of the lower surface 2 even though the surface 2 is provided with the aforediscussed recesses 3 to 7. The base 1 can be used with advantage on sandals, jogging shoes, running shoes, tennis shoes and other types of shoes which are used by runners, joggers, gymnasts and other athletes in gyms, on the field, on natural or artificial turf, on paved roads and elsewhere. Articles of footwear embodying the improved base can be used by professional and amateur athletes as well as by messengers, children and others. It is further within the purview of the invention to provide the third section of the base 1 with a more or less pronounced raised heel or with a negative heel.

The feature that the depth of the recesses is related to the magnitude of stresses which are applied to the corresponding portions of the upper surface 102 also contributes to greater stability of the base 1 by enabling the material of the base to yield to an extent which is a function of the magnitude of the force acting upon the respective section of the base. Heretofore, recesses of lesser depth were provided primarily in the upper surface of the base.

Figure 8:
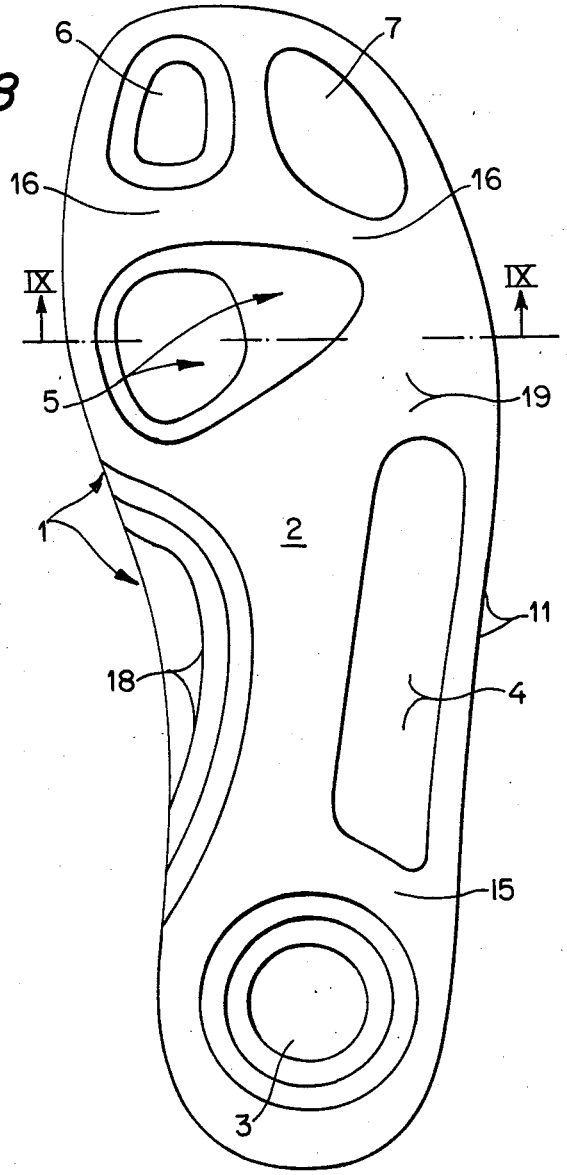
FIG. 8 is a bottom plan view of a modified base.
Figure 9:
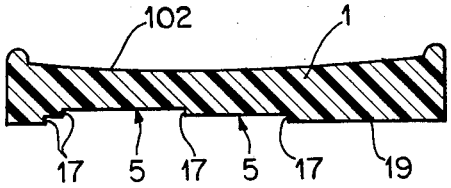
FIG. 9 is a sectional view as seen in the direction of arrows from the line IX—IX of FIG. 8.
Figure 10:
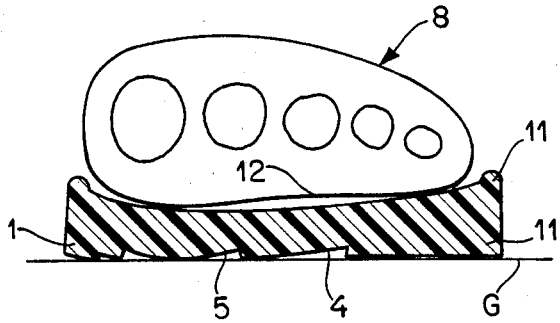
FIG. 10 illustrates the structure of FIG. 9 but with the corresponding section of the first part of the base in deformed condition.

FIGS. 8 to 10 illustrate a modified base 1 whose sections, parts, recesses and bridges are denoted by reference characters corresponding to those used in FIGS. 1 to 7. The main difference between the bases of FIGS. 1 and 8 is that the second portion of the base 1 of FIG. 8 comprises a further bridge 19 between the transversely extending composite recess 5 in the lower surface portion below the first section of the first part of the base and the lower surface portion below the outer part of the instep. The depth of the recess 4 can equal or approximate the depth of the shallower portion of the recess 5 and the depth of the deeper portion of the recess 5 can equal or approximate that of the recess 6. The depth of the recess 6 can exceed that of the recess 7, and the depth of the recess 3 can exceed the depth of each other recess or it can approximate the depth of the deeper portion of the recess 5 and/or the depth of the recess 6. That portion of the lower surface 2 of the base 1 shown in FIGS. 8–10 which is provided on the bridge 19 is or can be serrated. The function of the bridge 19 is analogous to that of the bridges 15 and 16. The provision of serrations on the bridges reduces the likelihood of slippage of the base along the floor or ground G, and the provision of serrations in the recesses 3 to 7 is desirable on the same ground. It is to be borne in mind that the surface portions which are provided with the recesses 3 to 7 preferably contact the floor or ground when the corresponding sections of the first part of the base 1 are deformed.

An important advantage of the improved base is that it accomplishes several apparently contradictory objects, namely of adequately supporting and stabilizing the foot, of rendering it possible to use a normally flat or substantially flat upper surface 102, and of affording great comfort to the user. Furthermore, each and every portion of the improved base is designed in such a way that it affords comfort to the user's foot when the corresponding part of the base is stressed during walking, jogging, jumping, running or while the user stands still. The reaction of the improved base to application of stresses to its upper surface is analogous to that of a layer of sand on which a person is walking barefoot, i.e., the sand yields and the person leaves footprints complementary to the shape of those portions of the feet which come in contact with the sand. The beneficial effect of the improved base is felt during walking, running, jogging or other movement along soft ground or on hard ground. The exact composition of the material of the base 1 forms no part of the invention. Any one of a wide variety of materials which are presently used to make elastically deformable and compressible soles, heels and like parts of articles of footwear can be used with advantage, as long as the material is sufficiently elastic and compressible to allow for the aforediscussed deformation of various sections of the base. If desired, the upper surface 102 of the base 1 can be slightly profiled (e.g., concave) so that it generally conforms to the shape of the adjacent portion of the foot but without causing discomfort, i.e., without necessarily closely or very closely following the outline of the foot. The foot of the wearer deforms the base 1 during jogging, running, etc. so that the configuration of the upper surface 102 changes continuously from the rear end toward the front end during different stages of contact of the lower surface with the floor or gound. As mentioned above, the area of contact between the floor or ground and various portions of the lower surface 2 increases in response to the application of stresses and/or shocks to the corresponding sections of the first part of the base 1 so that the supporting action of such sections is thereby increased and the stability of the base and its supporting action are also increased. The article of footwear employing the improved base can be used by persons having normal or slightly or even pronouncedly abnormal feet because the configuration of the base conforms to the shape of the foot to any desired extent by appropriate selection of the material of the base and/or by appropriate selection of the distribution and depth of recesses in the lower surface 2.

The grooves, tooth spaces and like depressions which are provided in serrated portions of the lower surface 2 of the improved base 1 are not considered equivalents of the recesses 3–7, because they are normally rather shallow and merely serve to ensure that the serrations at the undersides of the bridges 15, 16, 19 and 20 can reduce the likelihood of slippage but do not contribute appreciably to deformability of the material of such bridges.

The base 1 can be used with advantage in shoes, sandals and many other types of articles of footwear. As mentioned above, the effect is similar to that when a person is walking or running barefoot on sand except that the improved base also enhances the lateral stability of the foot, i.e., it reduces the likelihood of twisting or other injuries. Moreover, the base 1 can undergo extensive wear without a pronounced reduction of its effectiveness which disappears or is considerably reduced only when the depth of all recesses 3–7 or of the majority of such recesses is reduced to a small fraction of their original depth.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A footwear base containing an elastically deformable cushioning amterial and having an upper surface for supporting the weight of the foot and a substantially plane lower surface arranged to contact the ground, said base including a first part which absorbs more pronounced shocks and a second part which absorbs less pronounced shocks when the article of footwear embodying the base is in use, said lower surface having recessed portions on said first part, and said first part comprising a first section for the ball of the foot having at least one first recess, a second section for the toes having at least one second recess, a third section for the heel having at least one third recess, and a fourth section for the outer part of the instep having at least one fourth recess, each of said recesses having a depth which is related to the loading of the respective section such that the recess in a more heavily loaded section has a greater depth that the recess in a less heavily loaded section, and said base further including a marginal part, said lower surface having a substantially circumferentially complete non-recessed border portion which circumscribes all recesses in said lower surface and spaces all recesses in said lower surface from said marginal part, said lower surface further having additional portions which, together with said border portion, completely surround at least three of said recesses.

2. The base of claim 1, wherein said second part includes a bridge between said third and fourth recesses.

3. The base of claim 1, wherein said first and fourth recesses are in communication with each other.

4. The base of claim 1, wherein said second part includes a bridge between said first and second recesses.

5. The base of claim 1, wherein said second section has several discrete recesses.

6. The base of claim 5, wherein said discrete recesses include a recess below the big toe and an additional recess below the small toes of the foot which is adjacent to said upper surface.

7. The base of claim 1, wherein said third recess is deeper than at least one other recess.

8. The base of claim 1, wherein said first portion is deeper than at least one other recess.

9. The base of claim 1, wherein said first section has a plurality of recesses and one of said plurality of recesses is deeper than at least one other recess.

10. The base of claim 1, wherein said second which recess is disposed below the big toe of the foot adjacent to said upper surface and is deeper than at least one other recess.

11. The base of claim 1, wherein the depths of said recesses in unstressed condition of the respective sections are such that the depth of at least a predetermined portion of each recess is reduced substantially to zero in response to the application of a shock to the respective section of said first part.

12. The base of claim 11, wherein each of said recesses has a substantially central portion which constitutes the respective predetermined portion.

13. The base of claim 1, wherein said lower surface includes a serrated non-recessed portion.

14. The base of claim 1, wherein said lower surface further includes additional portions which merge substantially gradually into said recessed and non-recessed portions.

15. The base of claim 1, wherein said lower surface further includes stepped additional portions between said recessed and non-recessed portions.

16. The base of claim 15, wherein said additional portions define steps of identical or similar height and the number of steps adjacent to deeper recesses exceeds the number of steps adjacent to shallower recesses.

17. The base of claim 16, wherein said deeper recesses include said third recess.

18. The base of claim 17, wherein said deeper recesses further include said first and second recesses.

19. The base of claim 18, wherein said additional portions have pairs of steps surrounding said deeper recesses and single steps surrounding said shallower recesses.

20. The base of claim 16, wherein the height of each of said steps is between about 0.5 and 1.5 mm.

21. The base of claim 16, wherein the height of each of said steps is between about 0.75 and 1 mm.

22. The base of claim 16, wherein the height of each of said steps is between about 0.8 and 1 mm.

23. The base of claim 16, wherein said steps merge substantially gradually into said non-recessed portion and establish abrupt transitions between said additional portions and said recessed portions.

24. The base of claim 1, wherein the maximum depth of said recesses is approximately 3 mm.

25. The base of claim 1, wherein said second part includes a bridge between said first and fourth recesses.

26. The base of claim 1, wherein said first recess extends transversely toward but short of said fourth recess.

27. The base of claim 1, wherein said recessed portions are serrated.

28. The base of claim 1, wherein said fourth recess is shallower than the other recesses.

29. The base of claim 1, said first recess being disposed at the inner part of the ball, and said second recess being disposed at the big toe; and wherein said fourth recess is shallower than at least one of said first, second and third recesses.

30. The base of claim 29, wherein said fourth recess is shallower than each of said first, second and third recesses.

31. The base of claim 29, said second section having an additional recess in the region of at least some of the small toes; and wherein said additional recess is shallower than at least one of said first, second and third recesses.

32. The base of claim 3, wherein each of said fourth and additional recesses is shallower than each of said first, second and third recesses.

* * * * *